US007448932B2

(12) United States Patent
Buckley et al.

(10) Patent No.: US 7,448,932 B2
(45) Date of Patent: Nov. 11, 2008

(54) TOY

(75) Inventors: Mark Buckley, London (GB); Brian Whitehead, London (GB)

(73) Assignee: Origin Products, Ltd., London (GB)

( * ) Notice: Subject to any disclaimer, the term of this patent is extended or adjusted under 35 U.S.C. 154(b) by 227 days.

(21) Appl. No.: 11/108,182

(22) Filed: Apr. 18, 2005

(65) Prior Publication Data

US 2006/0099876 A1 May 11, 2006

(30) Foreign Application Priority Data

Nov. 10, 2004 (GB) ..... 0424776.3

(51) Int. Cl.
*A63H 3/00* (2006.01)
*A63H 3/08* (2006.01)

(52) U.S. Cl. ..... 446/83; 446/135

(58) Field of Classification Search ..... 446/97–101, 446/92, 129–139, 387, 388, 901, 83
See application file for complete search history.

(56) References Cited

U.S. PATENT DOCUMENTS

| | | | | |
|---|---|---|---|---|
| 618,810 | A | | 1/1899 | Wood |
| 718,721 | A | | 1/1903 | Nelson |
| 1,330,043 | A | | 2/1920 | Cleaver |
| 1,611,155 | A | | 12/1926 | Bisaillon |
| 1,868,427 | A | | 7/1932 | Moore |
| 1,879,022 | A | | 9/1932 | Alles |
| 2,079,550 | A | | 5/1937 | DeMott |
| 2,220,049 | A | | 10/1940 | Dunmore |
| 2,283,104 | A | | 5/1942 | Surman |
| 2,363,914 | A | | 11/1944 | Wakefield |
| 2,465,971 | A | | 3/1949 | Leblang |
| 2,944,368 | A | | 7/1960 | O'Brian et al. |
| 2,987,831 | A | | 6/1961 | Stepat et al. |
| 3,032,345 | A | * | 5/1962 | Lemelson ..... 273/348.4 |
| 3,090,155 | A | | 5/1963 | Gordon |
| 3,093,919 | A | | 6/1963 | Holtz |
| 3,210,884 | A | | 10/1965 | Sharff et al. |
| 3,246,422 | A | | 4/1966 | Teagarden |
| 3,316,669 | A | * | 5/1967 | Nachbar ..... 40/620 |
| 3,375,604 | A | | 4/1968 | Alonso |
| 3,592,469 | A | | 7/1971 | Glass et al. |
| 3,593,454 | A | | 7/1971 | Einfalt |
| 3,660,926 | A | | 5/1972 | Lerner et al. |
| 3,672,082 | A | | 6/1972 | Tepper et al. |
| 3,675,362 | A | | 7/1972 | De Gelder et al. |
| 3,693,283 | A | | 9/1972 | Marcus |
| 3,724,101 | A | | 4/1973 | Slezak |
| 3,785,648 | A | | 1/1974 | Kobayashi |
| 3,789,538 | A | | 2/1974 | Spengler et al. |

(Continued)

FOREIGN PATENT DOCUMENTS

| | | |
|---|---|---|
| EP | 0585248 | 11/1996 |

(Continued)

*Primary Examiner*—Nini Legesse
(74) *Attorney, Agent, or Firm*—Woodard, Emhardt, Moriarty, McNett & Henry LLP

(57) ABSTRACT

A toy includes a toy member and one or more articles for detachable attachment to said toy member. Movement apparatus is provided for moving the articles between a first position, wherein the articles are detached from and a spaced distance apart from the toy member, and a second position, wherein the articles are engaged with with the toy member.

23 Claims, 10 Drawing Sheets

U.S. PATENT DOCUMENTS

| | | | | |
|---|---|---|---|---|
| 3,849,930 | A | 11/1974 | Stubbmann | |
| 3,883,984 | A | 5/1975 | Champeaux | |
| 4,012,040 | A | 3/1977 | Fernandes | |
| 4,026,066 | A | 5/1977 | Reiner et al. | |
| 4,030,736 | A | 6/1977 | Petrusek | |
| 4,038,775 | A | 8/1977 | Sato | |
| 4,068,403 | A | 1/1978 | Weiser | |
| 4,118,888 | A | 10/1978 | Ogawa | |
| 4,123,865 | A | 11/1978 | Pearson | |
| 4,139,967 | A | 2/1979 | Kuna et al. | |
| 4,161,081 | A | 7/1979 | Katzman et al. | |
| 4,165,579 | A | 8/1979 | Chase | |
| 4,176,492 | A | 12/1979 | Sims et al. | |
| 4,233,778 | A | 11/1980 | Lemelson | |
| 4,356,658 | A | 11/1982 | Goldfarb | |
| 4,437,262 | A * | 3/1984 | Kaga | 446/138 |
| 4,493,669 | A | 1/1985 | Neuhierl | |
| 4,710,979 | A | 12/1987 | Bull et al. | |
| 4,834,371 | A | 5/1989 | Hay et al. | |
| 4,846,689 | A | 7/1989 | Day | |
| 4,925,423 | A * | 5/1990 | Miller et al. | 446/98 |
| 4,961,716 | A | 10/1990 | Hippely et al. | |
| 5,021,020 | A | 6/1991 | Hambley et al. | |
| 5,022,886 | A | 6/1991 | Jenkins | |
| 5,046,985 | A | 9/1991 | Cearfoss | |
| 5,178,573 | A | 1/1993 | Smith | |
| 5,328,400 | A | 7/1994 | Bass et al. | |
| 5,340,348 | A * | 8/1994 | Schroeder | 446/73 |
| 5,362,271 | A | 11/1994 | Butt | |
| 5,417,605 | A | 5/1995 | Chan | |
| 5,518,784 | A | 5/1996 | Fussell | |
| 5,666,712 | A | 9/1997 | Cvetkov | |
| 5,727,717 | A | 3/1998 | Vigne | |
| 5,743,780 | A | 4/1998 | Liu | |
| 5,820,383 | A | 10/1998 | Levins | |
| 5,890,944 | A | 4/1999 | Wiggs et al. | |
| 6,049,914 | A | 4/2000 | Heilman | |
| 6,056,619 | A | 5/2000 | Wiggs et al. | |
| 6,102,767 | A | 8/2000 | Wiggs et al. | |
| 6,193,581 | B1 | 2/2001 | Wiggs et al. | |
| 6,203,396 | B1 | 3/2001 | Asmussen et al. | |
| 6,206,746 | B1 | 3/2001 | Wiggs et al. | |
| 6,227,930 | B1 | 5/2001 | Norman et al. | |
| 6,386,937 | B1 | 5/2002 | Cappello et al. | |
| 6,434,801 | B2 | 8/2002 | Grunberger | |
| 6,475,054 | B1 | 11/2002 | Liu | |
| 6,511,359 | B1 | 1/2003 | Lui | |
| 6,604,976 | B2 | 8/2003 | Lenkoff | |
| 6,712,667 | B1 | 3/2004 | Melzer et al. | |
| 6,719,604 | B2 | 4/2004 | Chan | |
| 6,790,117 | B2 * | 9/2004 | Ruiz Gonzalez | 446/92 |
| 6,824,441 | B1 | 11/2004 | Wiggs et al. | |
| 2001/0016465 | A1 | 8/2001 | Norman et al. | |
| 2002/0022506 | A1 | 2/2002 | Rifkin | |
| 2002/0061700 | A1 | 5/2002 | Chan | |
| 2002/0077017 | A1 | 6/2002 | Lenkoff | |
| 2002/0115376 | A1 | 8/2002 | Whitehead | |
| 2002/0132552 | A1 | 9/2002 | To | |
| 2003/0077481 | A1 | 4/2003 | Wu | |
| 2003/0171062 | A1 * | 9/2003 | Ruiz Gonzalez | 446/92 |
| 2003/0176143 | A1 | 9/2003 | Ruiz | |
| 2003/0228825 | A1 | 12/2003 | Whitehead | |
| 2004/0077274 | A1 | 4/2004 | Becker | |
| 2004/0082259 | A1 | 4/2004 | Yum | |
| 2005/0130554 | A1 | 6/2005 | Isenberg | |
| 2006/0099876 | A1 | 5/2006 | Buckley et al. | |

FOREIGN PATENT DOCUMENTS

| | | | |
|---|---|---|---|
| EP | 1008374 | | 12/1998 |
| EP | 0893150 | | 1/1999 |
| EP | 1095683 | | 5/2001 |
| EP | 1 125 618 | A | 8/2001 |
| EP | 1125618 | A1 | 8/2001 |
| EP | 1364692 | A2 | 11/2003 |
| EP | 1371404 | A2 | 12/2003 |
| EP | 1364692 | A3 | 3/2004 |
| EP | 1371404 | A3 | 3/2004 |
| FR | 918 070 | A | 1/1947 |
| GB | 628186 | | 8/1949 |
| GB | 971596 | | 9/1964 |
| GB | 980856 | | 1/1965 |
| GB | 1031011 | | 5/1966 |
| GB | 1243600 | | 8/1971 |
| GB | 708238 | | 7/1980 |
| GB | 2264069 | | 8/1993 |
| GB | 2279886 | | 1/1995 |
| GB | 2315423 | | 2/1998 |
| GB | 2315424 | | 2/1998 |
| GB | 2318523 | | 4/1998 |
| GB | 2328622 | | 3/1999 |
| GB | 2328623 | | 3/1999 |
| JP | 03076804 | | 4/1997 |
| WO | WO 9728867 | | 8/1997 |
| WO | WO 03095057 | | 11/2003 |

* cited by examiner

TOY

BACKGROUND OF THE INVENTION

This invention relates to a toy.

Although the following description refers almost exclusively to a toy in the form of a playbase which depicts a miniaturised scene with one or more dolls located thereon for interaction with the playbase and/or one or more articles provided on the playbase, the design and mechanisms of which have previously been described in the applicants granted patents GB2315423, GB2315424, GB2328622, EP1371404, EP1125618 and GB2328623 and are incorporated herein by reference, the toy of the present invention can also be used alone or in combination with any other conventional toy design or toy mechanism.

It is known to provide a toy in the form of a doll or figurine to which one or more garments, accessories and/or the like can be detachably attached thereto. This allows a user, typically a child, to change the appearance of the doll by attaching different combinations of clothing and/or accessories to the doll. For example, in U.S. Pat. No. 5,178,573 a doll is formed from ferrous material to which magnetic clothing and/or accessories can be attached by a user placing the clothing onto the surface of the doll. EP1364692 discloses a similar arrangement whereby clothing and/or other accessories are manually positioned on a doll via magnetic means. However, both toys provide only limited interest to the user due to the unrealism of the toy and the manual attachment of the clothing and accessories.

SUMMARY OF THE INVENTION

It is an aim of the present invention to provide a toy which removes the requirement for manual attachment of one or more portions thereto in order to increase the realism of the toy to a user and thus maintain the interest of the toy to the user for a longer period of time than is the case with conventional toys.

It is a further aim of the present invention to provide a method of using a toy which removes the requirement for manual attachment of one or more portions thereto.

According to a first aspect of the present invention there is provided a toy, said toy including at least one toy member and one or more articles for detachable attachment to said toy member, characterised in that said toy further includes movement apparatus for moving said one or more articles between a first position, wherein the one or more articles are detached from and a spaced distance apart from said at least one toy member, and a second position, wherein the one or more articles are engaged with or are moved into engagement with said at least one toy member.

Preferably the at least one toy member and/or the movement apparatus is provided on a playbase in use. The toy member and/or the movement apparatus is typically movable with respect to said playbase. The playbase can include any planar or non-planar surface and can include a number of separate surfaces either joined together or a spaced distance apart.

Preferably the one or more articles are detachably attached to said at least one toy member via engagement means. These engagement means can include any conventional type of engagement means, such as one or more clips, VELCRO, ties, interconnecting members and/ox the like.

In a preferred embodiment the engagement means include first magnetic means and said first magnetic means can be provided on the at least one toy member and/or the one or more articles.

The term magnetic means includes one or more magnets or magnetically attractive material.

The one or more articles are typically detachably secured to the movement apparatus in said first position via securing means.

Once the one or more articles are moved within a pre-determined distance of said at least one toy member via the movement apparatus, the securing means are released and/or are weakened and the one or more articles are moved/brought into engagement with said at least one toy member.

The securing means can include any conventional securing arrangement, such as one or more hooks, ties, clips, interconnecting members and/or the like.

In a preferred embodiment the securing means include second magnetic means.

The first magnetic means (i.e. the magnetic means between the toy member and the one or more articles) are typically larger and/or generate a stronger magnetic field compared to the second magnetic means (i.e. the magnetic means between the one or more articles and the movement apparatus). As such, when the movement apparatus moves the one or more articles within a pre-determined distance of the at least one toy member, the first magnetic means provides a greater magnetic force or pull on the one or more articles compared to the magnetic force or pull provided between the one or more articles and the movement apparatus, thereby causing the one or more articles to become detached from the movement apparatus and engage with the at least one toy member.

Preferably the movement apparatus includes a support frame on which one or more support members are movably located.

In one embodiment the support frame is substantially stationary with respect to a playbase or other suitable surface.

In a further embodiment at least a part of the support frame is movably mounted to a surface of the playbase or other suitable surface. For example, the support frame can be rotatably or pivotally mounted with respect to a playbase surface.

In one embodiment the one or more support members are either directly or indirectly movably mounted on said support frame. For example, the support members can be rotatably mounted, slidably mounted and/or the like.

The one or more articles are typically detachably secured to at least a part of said one or more support members. Thus, in one embodiment, the second magnetic means are provided on a part of said one or more support members. Detachable attachment of the one or more articles to the toy member can take place via the toy member being moved within a pre-determined distance of said one or more articles, such as between said articles, via the one or more articles being moved a pre-determined distance from said toy member and/or as a result of actuation of a further mechanism.

Preferably the one or more support members include at least one support surface and the securing means are integrally formed therewith or provided in or on said support surface.

In one embodiment the support surface is movable relative to a part of said support member.

In one embodiment the support surface is pivotably mounted to a part of said support member. Pivotal motion of the support surface can be initiated as a result of magnetic attraction between the one or more articles and the toy member and/or as a result of the toy member being moved within a pre-determined distance of said support surface.

When the one or more articles are moved within a pre-determined distance of said at least one toy member, the magnetic attraction between the one or more articles and the toy member can be such that the support surface is caused to pivot towards said toy member, thereby bringing the articles into engagement with said toy member.

Alternatively, actuating means can be provided on the at least one toy member and/or said support surface and when the toy member and support surface engage or are brought within a pre-determined distance of each other, said actuating means can cause pivotal movement of the supporting surface, thereby bringing the articles into engagement with said toy member.

In one embodiment the support surface is in a set back position with respect to the at least one toy member when the movement apparatus is in the first position and in a forwardly position when the movement apparatus is in said second position.

The one or more support members and/or support frame can be provided with a handle portion or user actuation means to allow a user to move the same if required.

In one embodiment the at least one toy member is movable with respect to the playbase. The mechanism which allows this movement can be any conventional mechanism, such as magnetic means, mechanical means, electrical means and/or the like. The toy member movement mechanism can be provided in, below or on the playbase as required.

In a preferred embodiment the at least one toy member is slidably and/or rotatably located directly or indirectly on said playbase.

In one embodiment the movement apparatus is integrally formed with or is provided at least partly in a housing.

The housing typically has one or more openings provided therein to provide an entrance and/or exit for movement of the at least one toy member in and out of said housing and/or to allow the movement apparatus to be movable relative thereto.

In one embodiment the housing typically acts as a dressing room to allow the one or more articles to be located with said at least one toy member. A user's view of the housing interior via the one or more openings can be restricted by providing closure means on said openings if required. As such, the one or more articles can be located on said toy member in the housing without a user seeing the process via which this is done, thereby increasing the realism of the toy to the user.

In a further embodiment the housing can be in the form of a lift between different levels of a playbase. The lift can be formed from transparent material or opaque material such that a user cannot see the articles being located with or removed from the toy member in use.

Preferably the support frame of said movement means is provided in or integrally formed with said housing.

In one embodiment the support surfaces are located in said housing when the movement apparatus is in said second position. The support surfaces are preferably movable out of said housing when the movement apparatus is in said first position to allow the one or more articles to be secured to said support surfaces.

The support surfaces can be planar or flat or can be curved or non-planar.

According to a second aspect of the present invention there is provided a method of using a toy, said toy including at least one toy member and one or more articles for detachable attachment to said at least one toy member, said method including the steps of moving said one or more articles using movement apparatus between a first position, wherein the one or more articles are detached from and a spaced distance apart from said at least one toy member, and a second position, wherein the one or more articles are engaged with or are capable of being engaged with said at least one toy member.

The playbase defined herein can be any suitable planar or non-planar surface on which the toy member and/or movement apparatus can be located.

The toy member can be in the form of any suitable character, human, animal, monster, imaginary creature, article and/or the like.

The one or more articles for attachment to the toy member can include one or more garments, accessories, appendages, hair pieces, items and/or the like which in combination with the toy member alter the appearance, realism and/or function of the same. The articles can be located as a single article to the toy member and/or the article may include a number of portions, each of which are attached to the toy member to form the article.

The advantage of the present invention is that it provides a means of automatically attaching one or more articles/portions, such as accessories, clothing, armoury and/or the like to a toy member to change the appearance and/or function of the toy member in a realistic manner. The steps involved in this change of appearance or function are typically hidden from a user such that it appears to a user that the toy member has attached the articles/portions itself, thereby increasing the realism of the toy to a user.

BRIEF DESCRIPTION OF THE SEVERAL VIEWS OF THE DRAWINGS

Embodiments of the present invention will now be described with reference to the accompanying figures, wherein.

DETAILED DESCRIPTION OF THE INVENTION

Figure 1:
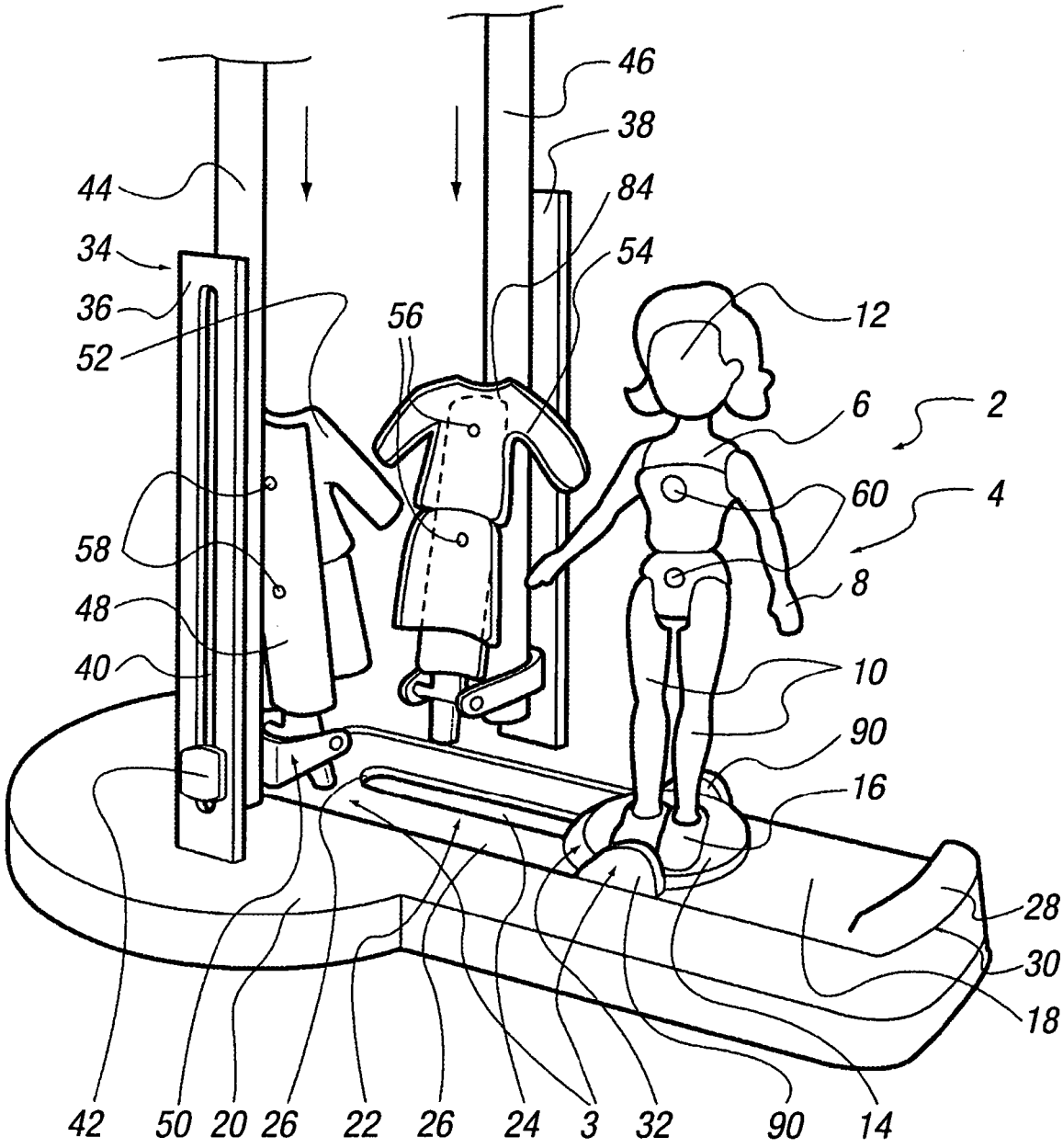
FIG. 1 is a perspective view of part of the toy without a housing in one embodiment of the present invention.
Figure 2:
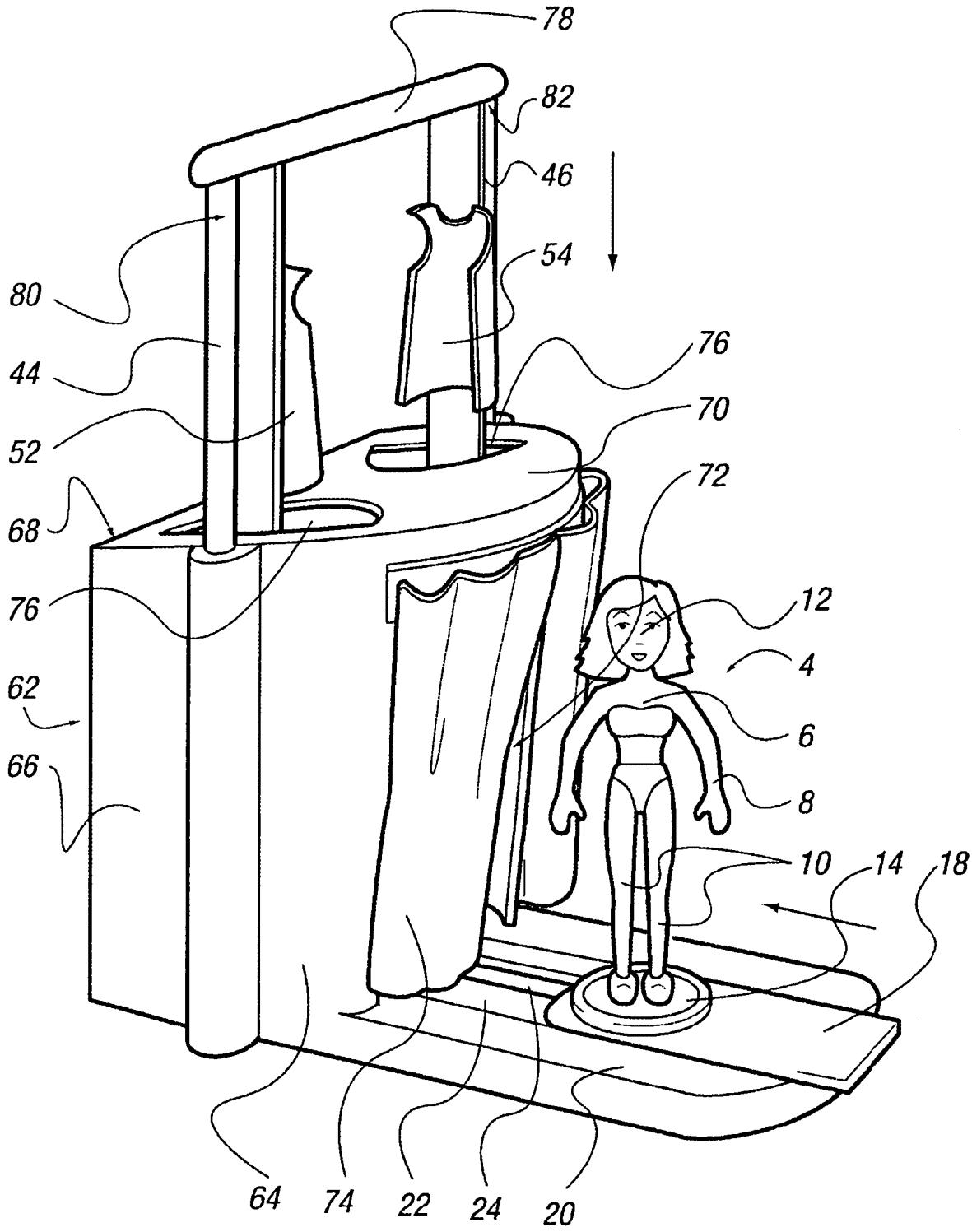
FIG. 2 is a perspective view of the toy in FIG. 1 with a housing.

Referring firstly to FIGS. 1-2, there is illustrated a toy 2 for allowing a toy member in the form of a doll 4 to have one or more portions in the form of clothes and accessories to be automatically detachably attached thereto, thereby allowing the appearance and/or function of the doll to be changed. This increases the realism of the toy, and particularly the doll portion of the toy, to a user.

In the illustrated example, the doll 4 is in form of a human female having a suitably shaped body portion 6, arms 8, legs 10 and a head 12. The doll is provided with underwear but no other clothes in this example. The head, arms and/or legs can be movable relative to the body portion using any conventional mechanism, such as for example, one of the mechanisms set out in the applicant's previous patents as mentioned on page 1 of this application. Alternatively the head, arms and/or legs can be fixed with respect to the body portion.

The dolls feet are attached to a platform 14 via shoes 16. The shoes 16 and/or feet can be fixed to platform 14 and/or can be detachably attached thereto to allow the doll 4 to be removed.

Platform 14 is located on an arm member 18 and said arm member is slidably mounted on a playbase 20. More specifically, a recess portion 22 is defined in playbase 20 and a channel 24 is provided in the base 26 of said recess portion. Arm member 18 is located in recess portion 22, such that an upper surface of arm member 18 is substantially flush with the surrounding surface of playbase 20 defining recess portion 22. A protrusion portion (not shown) on the underside surface of arm member 18 is slidably located in channel 24, thereby allowing arm member 18 to be moved in said channel between a first end 26 of the channel and an opposite end. A handle portion 28 is provided on end 30 of arm member 18 opposite to the end 32 on which platform 14 is located. The handle portion 28 can be gripped by a user to move the arm member and thus doll 4 with respect to the playbase.

Movement apparatus is provided on the playbase to allow one or more articles of clothing to be moved into engagement with the doll and/or to be moved out of engagement with the doll. The movement apparatus includes a support frame 34 provided on playbase 20 adjacent end 26 of channel 24. The support frame 34 includes two upright frame members 36, 38 which are provided substantially parallel and set a spaced distance apart to each other on either side of recess portion 22.

Each of frame members 36, 38 has a slot 40 provided longitudinally thereof and protrusion portions 42 provided on support members 44, 46 are slidably located in said slot. Each of support members 44, 46 are provided with a support surface 48, 48' and the support surfaces 48, 48' are pivotally mounted to support members 44, 46 respectively via a bracket 50. Thus, the support surfaces 48, 48' can be moved with respect to support members 44, 46 in use.

The one or more articles of clothing which are to be attached to the doll in use are secured to support surfaces 48, 48'. In this example the articles of clothing are in the form of a dress for location with doll 4 and the dress includes a front dress portion 52 and a rear dress portion 54 located on surfaces 48, 48' respectively. The dress portions 52, 54 are shaped so as to substantially correspond to the shape of the body portions of the doll to which they are to be located with. It will be appreciated by persons skilled in the art that the article portions can be any suitable shape, size or design.

In the embodiment described, the front and rear dress portions 52, 54 are provided with magnets 56 thereon which have opposite polarity to magnets 58 provided on support surfaces 48, 48'. The magnetic fields of magnets 56, 58 interact to cause engagement between the dress portions and the support surfaces.

Larger and/or stronger magnets 60 are provided at suitable locations in or on doll 4 and these magnets have opposite polarity to the magnets provided on dress portions 52, 54, such that when doll 4 is moved substantially into alignment with support frame 34 (i.e. arm member 18 is moved to channel end 26), the magnetic attraction between the dress portions 52, 54 and doll 4 is greater than the magnetic attraction between the dress portions 52, 54 and support surfaces 48, 48'. This causes engagement between the dress portions 52, 54 and support surfaces 48, 48' to be released and the dress portions to become magnetically attached to doll 4.

Alignment means can be provided on the support surfaces and/or the doll to ensure the dress portions are attached to the correct portion of the doll. The alignment means in one example could include an outline of the dress portions on the support surfaces and/or the like.

To further increase the realism of the doll dressing itself, the attachment of the dress portions to the doll can take place in a housing 62 as shown in FIG. 2. The housing 62 includes a front wall 64, side walls 66, rear wall, 68 and top 70 and is located on playbase 20. An entrance/exit opening 72 is defined in front wall 64 and closure means in the form of a curtain 74 is provided over opening 72 to hide the interior of housing 62 from a user.

The support frame 34 can be integrally formed with housing 62 or can be provided therein. In this embodiment the support frame 34 forms part of side walls 66.

Top 70 of housing 62 is provided with two suitably shaped apertures 76 therein to allow movement of support members, 44, 46, support surfaces 48, 48' and dress portions 52, 56 therethrough. A handle 78 is provided between ends 80, 82 of support members 44, 46 to aid movement of the support members with respect to the support frame.

In use of the toy, a user locates doll 4 on platform 14 and slides arm member 18 towards housing 62 such that doll 4 passes behind curtains 74 and through opening 72 in said housing.

A user moves handle 78 and thus support members 44, 46 to an upper first position, such that dress portions 52, 54 or any other suitable type of clothing of accessory can be attached to support surfaces 48, 48' which are positioned above top 70. The user pushes handle 78 towards top 70 of housing 62 so as to lower the dress portions into housing 62 to a second position. The dress portions are transferred to the doll in the second position by virtue of the stronger magnetic attraction between the doll and the dress portions than between the dress portions and the support surfaces.

The user can then move arm member 18 away from the housing 62 and the doll 4 exits the housing with the clothes attached thereto.

It is to be noted that the loading of the clothes on the support members and the movement of the doll into housing 62 can take place in any order.

In the embodiment illustrated, the support surfaces 48, 48' are provided at an acute angle with respect to the support members 44, 46. More specifically, a top edge 84 of support surfaces 48, 48' are closer to support members 44, 46 than a peg 86 provided on bottom edge 88. As such, peg 86 protrudes inwardly of support members 44, 46. Flanges 90 provided on either side of platform 14 protrude outwardly thereof and when platform 14 is moved between support members 44, 46, flanges 90 engage with peg 86, thereby causing support surfaces 48, 48' to pivot inwardly from a set back position to a forwardly position, thereby moving the dress portions closer to the doll and increasing the ease with which the magnetic attraction between the doll and dress portions becomes greater than the magnetic attraction between the support surfaces and dress portions.

Figures 3A, 3B:
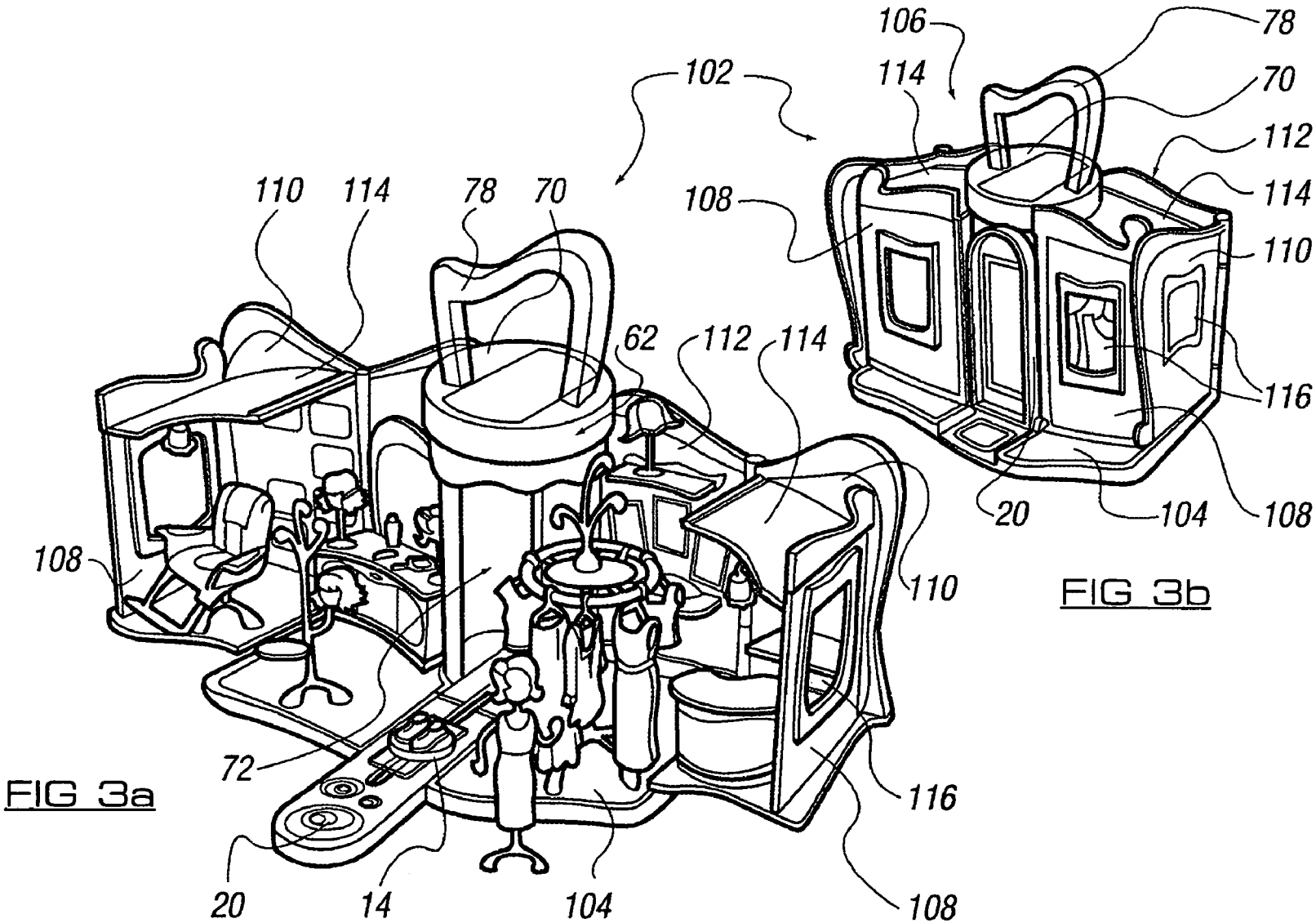
FIG. 3*a* is a perspective view of the toy in use on a playbase in one embodiment in an open in-use configuration.
FIG. 3*b* is a perspective view of the playbase in FIG. 3*a* when in a closed out-of-use configuration.
Figure 4:
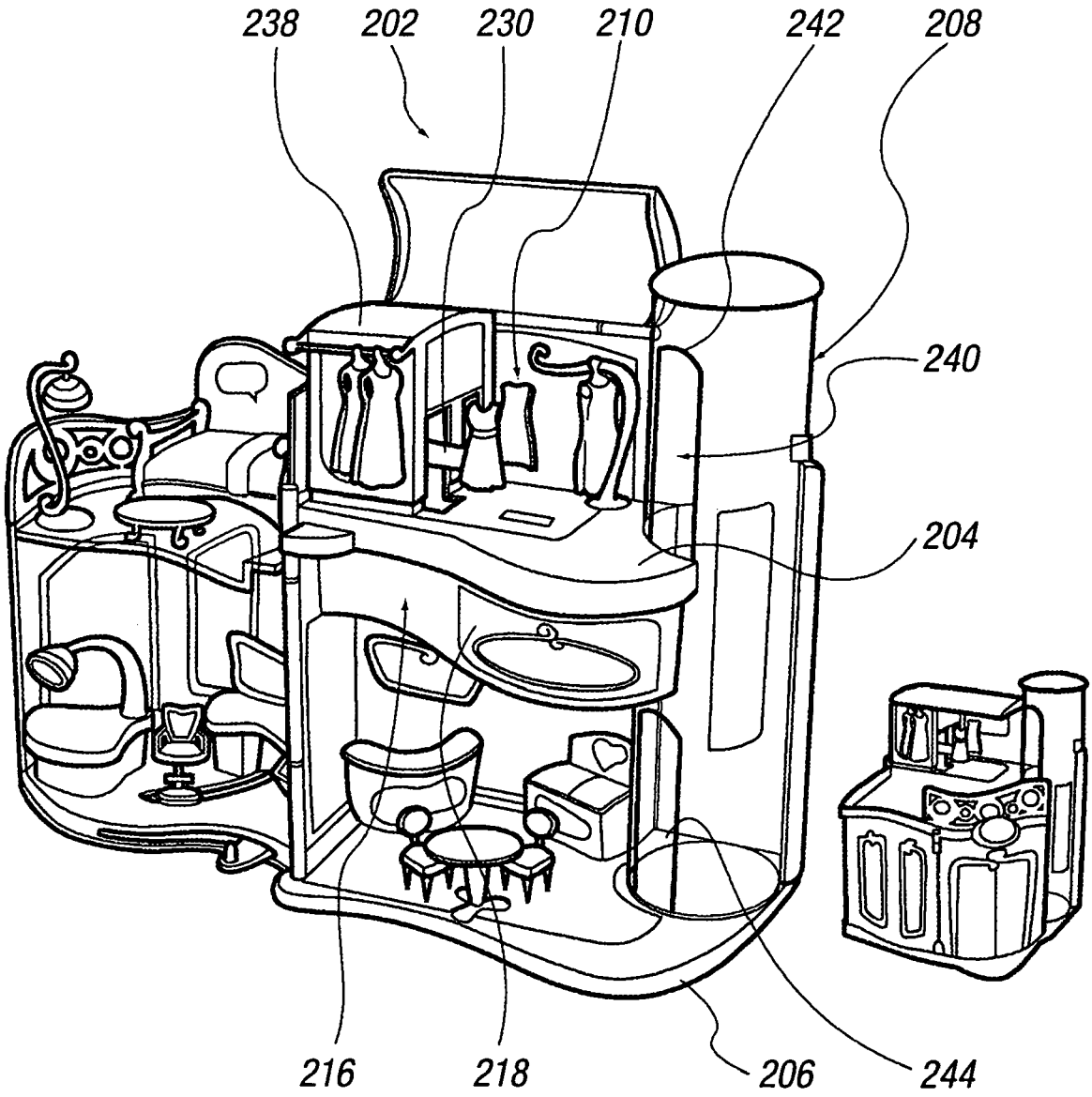
FIG. 4 is a perspective view of a playbase according to a further embodiment of the present invention in the form of a building or penthouse with a lift.

The playbase 20 described above can be provided in any suitable setting to form part of a larger toy and an example of a larger toy 102 is shown in FIGS. 3*a*, 3*b*. In this example, the playbase 20 is located in the base 104 of a container 106.

The container 106 includes front walls 108, side walls 110, a rear wall 112 and top portions 114. In the example illustrated, the container is in the form of a boutique and the housing 62 is in the form of a dressing room in the boutique. Any suitable articles, designs, decoration and/or the like can be provided in or on the container to increase the realism of the container being a boutique.

The side walls 110 are hingedly connected to rear wall 112, thereby allowing the container to be moved between an open in use configuration, as shown in FIG. 3*a*, and a closed out of use configuration, as shown in FIG. 3*b*. In the open configuration, the side walls 110 form part of the rear wall 112. One or more windows 116 can be provided in the walls of the container if required and the handle 78 of the loading mechanism for the dress portions can also be used as the handle for transporting the container.

The playbase 20 can be hingedly connected to base 104, such that it can be moved between a substantially horizontal position when the container is in the open configuration and a substantially vertical position to form part of front wall 108 when the container is in a closed configuration.

The toy can be formed from any suitable material and can be provided in any suitable shape, size or design. The toy member or doll can be in any suitable animal, human, character or article to which one or more articles, accessories, portions and/or the like are to be detachably attached thereto.

When the user wishes to change the appearance of the doll, the user can simply pull the portions off the doll and load new portion on the support surfaces for attachment to the doll in the manner as described above.

Referring to FIGS. 4-6*d*, there is illustrated a further embodiment of the present invention in use on a playbase which forms part of a building or penthouse 202.

The penthouse 202 includes two playbase surfaces; an upper playbase surface 204 and a lower playbase surface 206. A lift 208 is provided between the upper and lower playbase surfaces 204, 206 to allow a doll 4 to be transported therebetween.

In accordance with the present invention, the doll can have one or more articles in the form of clothing 210 detachably attached thereto without direct manual attachment by movement means via one of two possible routes as will be described in more detail below.

Movement means 212 for moving the articles of clothing 210, which in this example are provided in two halves; a front half 210*a* and a rear half 210*b*, into engagement with the doll 4 are provided. These movement means 210 include a support frame 214 which is rotatably mounted to upper playbase surface 204.

More specifically, a compartment 216 is provided below upper playbase surface 204 in which the movement means is movable and the support frame 214 is attached to interior side walls 218 of said compartment 216.

The support frame 214 includes a substantially U-shaped frame 220 which can be a single integral frame member or a number of frame members joined together. Spindles or pins 222 located on either side wall 224 of frame 220 are rotatably mounted to side walls 218. A user actuation knob 226 is located on an external surface of compartment 216 (only shown in FIGS. 5*a*-6) and is connected to spindle or pins 222, such that rotation of knob 226 by a user, as shown by arrows 228, results in rotation of support frame 220.

A support member 230 is rotatably mounted between ends 232 of support frame 220. The support member 230 is also in the form of a substantially U-shaped frame. The articles of clothing 210 are detachably attached to the free ends 234 of support member 230 as has previously been described using magnetic means. More specifically, a support surface 236 can be provided to which the articles of clothing are detachably attached. The support surface is joined to the free ends 234 of support member 230.

Figure 5A:
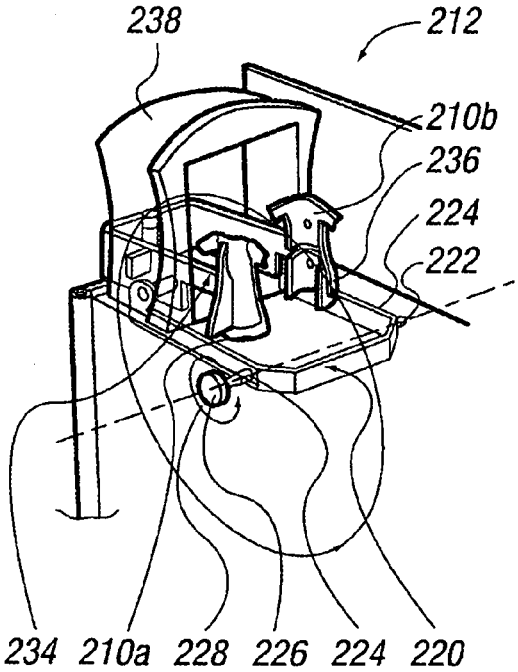
FIGS. 5*a*-5*d* illustrate the steps involved in movement of articles into engagement with a toy member in the embodiment illustrated in FIG. 4.
Figure 5B:
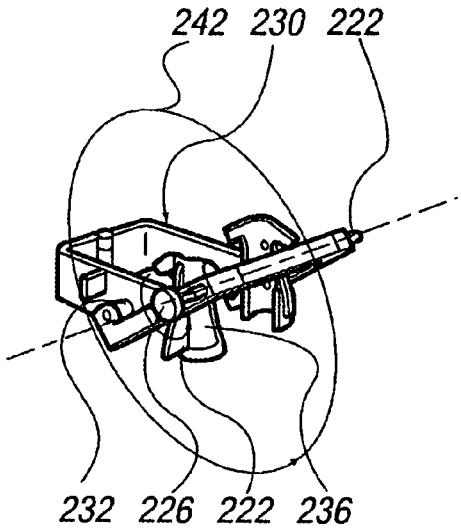
Figure 5C:
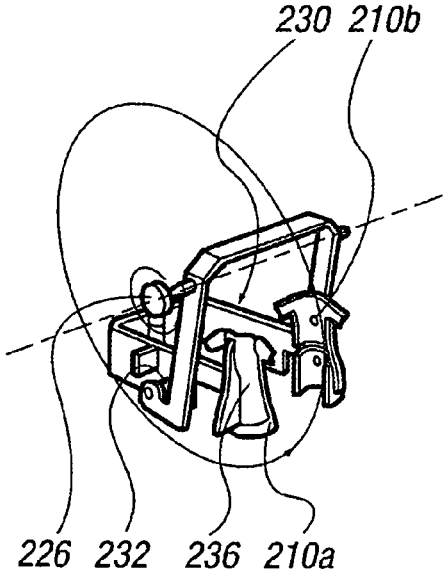
Figure 5D:
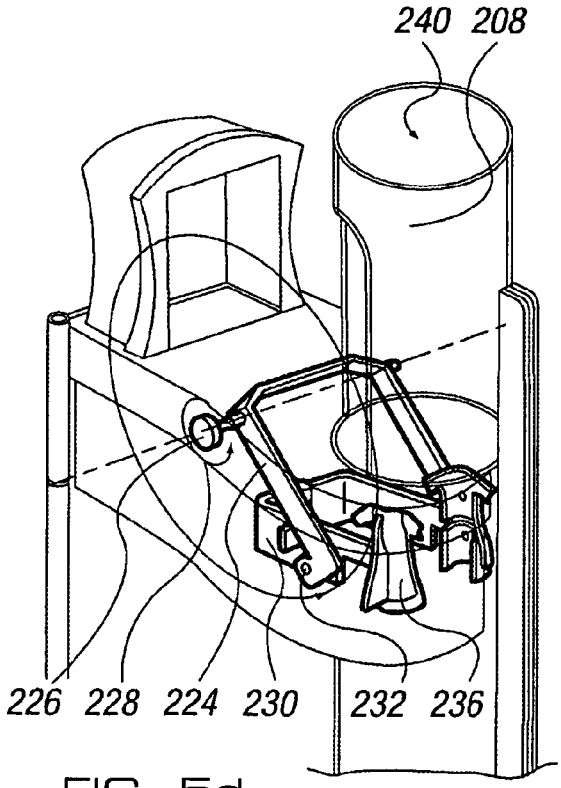

The movement means 212 are movable between a first raised position, as shown in FIG. 5*a*, wherein the support surfaces 236 are above the upper playbase surface 204, and a second lowered position, as shown in FIG. 5*d*, wherein the support surfaces 236 are below the upper playbase surface 204 and within compartment 216.

With the movement means in the first raised position, support frame 220 is typically substantially horizontal and/or parallel with upper playbase surface and is located in compartment 216 below upper playbase surface 204. Support member 230 is typically substantially horizontal and/or parallel to support frame 220 and upper playbase surface, and is located above upper playbase surface 204. Clothing 210 can be located on support surfaces 236 at the free ends of support member 230 since said free ends 234 typically protrude from a housing 238 in the form of a wardrobe located on top of upper playbase surface 204. A doll can be moved into the locality between clothing halves 210*a* and 210*b* and the clothing can be attached to the doll in a similar manner to that described for the previous embodiment.

On rotation of knob 226 by a user in an anti-clockwise manner, this causes support frame 220 to move in a downwardly direction. FIGS. 5*b* and 5*c* illustrate intermediate positions of the support frame as it is moved through substantially 180 degrees or less. As support frame 220 rotates, ends 232 thereof rotate with respect to support member 230, such that support member 230 is substantially perpendicular to or at an acute angle to side walls 224 of support frame 220.

With the movement means in a second lowered position, as shown in FIG. 5*d* and by dotted lines in FIG. 6, the support frame 220 is in compartment 216 and is at an acute angle to the upper playbase surface 204 and support member 230. Support member 230 is below upper playbase surface 204 and free ends 234 of said support member typically protrude into a cavity 240 defined in lift 208. Rotation of support member 203 to the raised and lowered positions is shown by arrow 242 also in an anticlockwise direction.

Figure 6A:
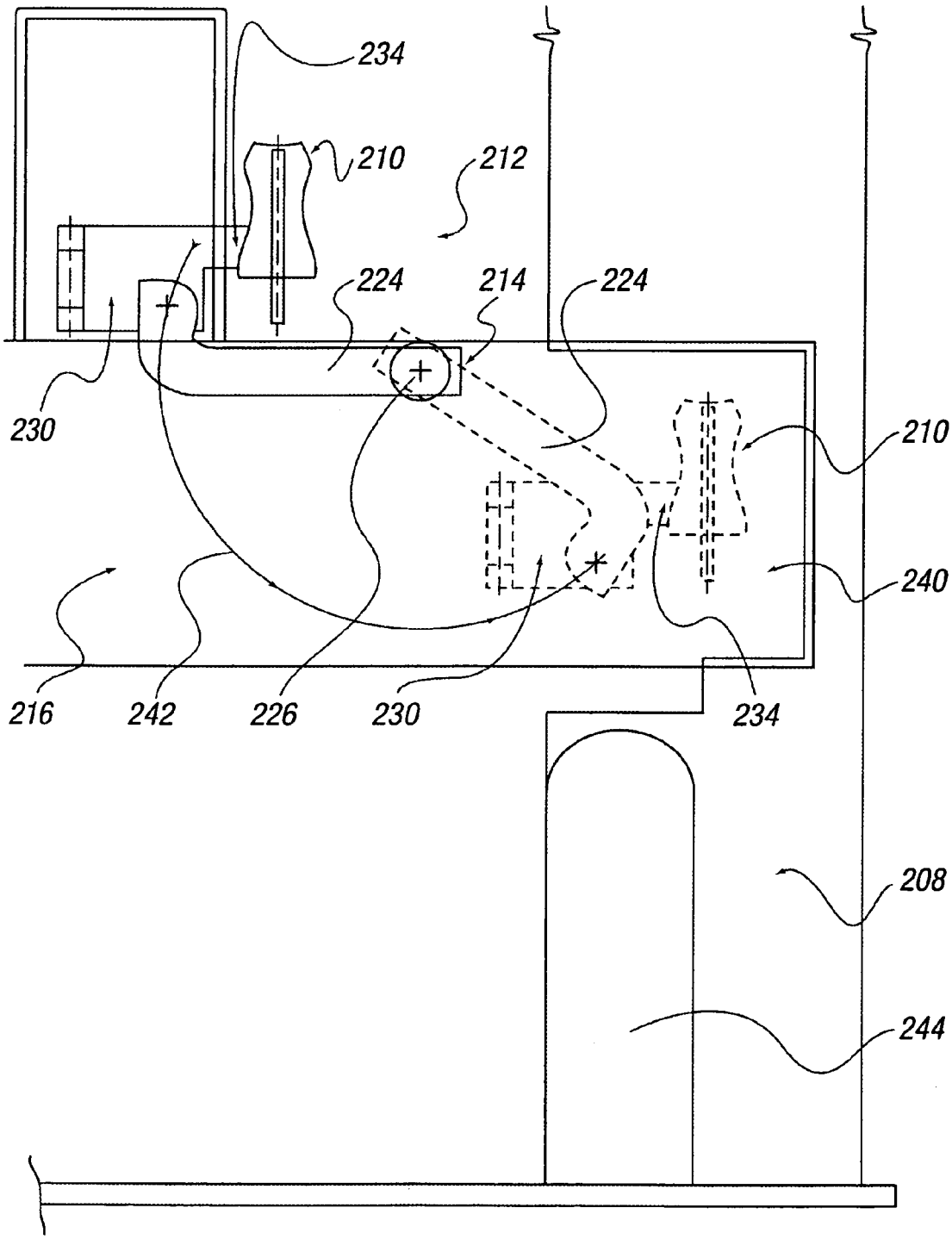
FIG. 6*a* illustrates a side view of the mechanism in FIGS. 4-5*d;*
Figure 6D:
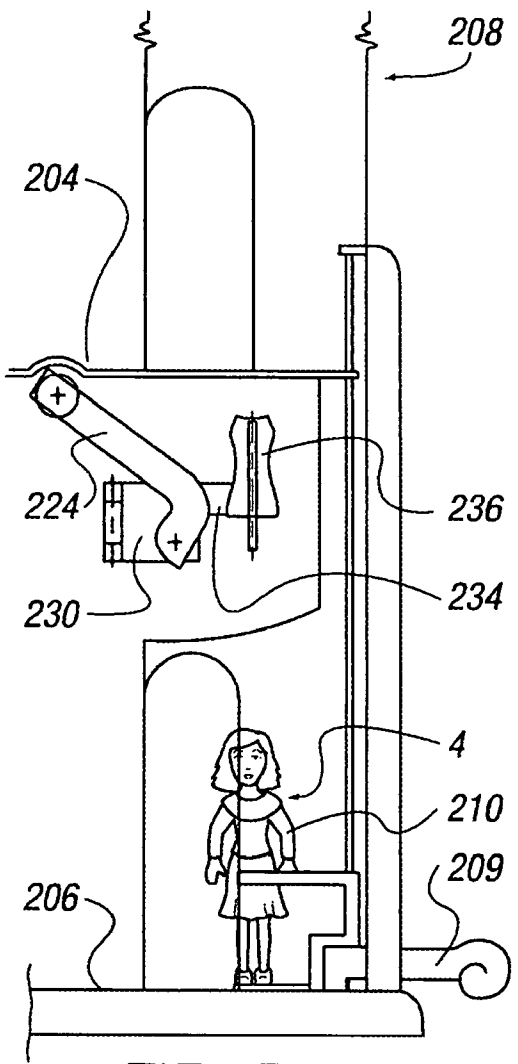
FIGS. 6*b*-6*d* illustrate a side view of the mechanism in FIGS. 4-6*a* in use with a doll.
Figure 6C:
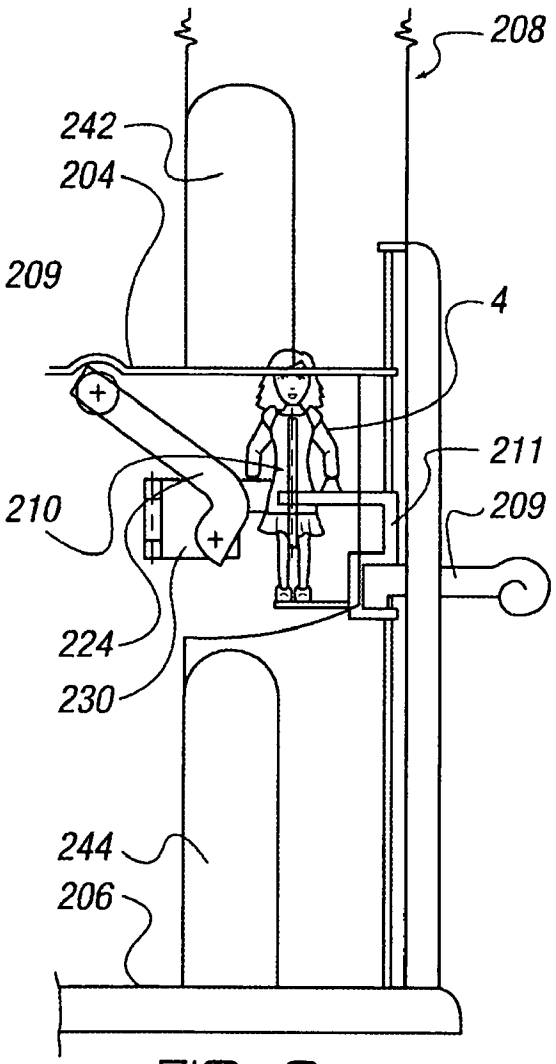
Figure 6B:
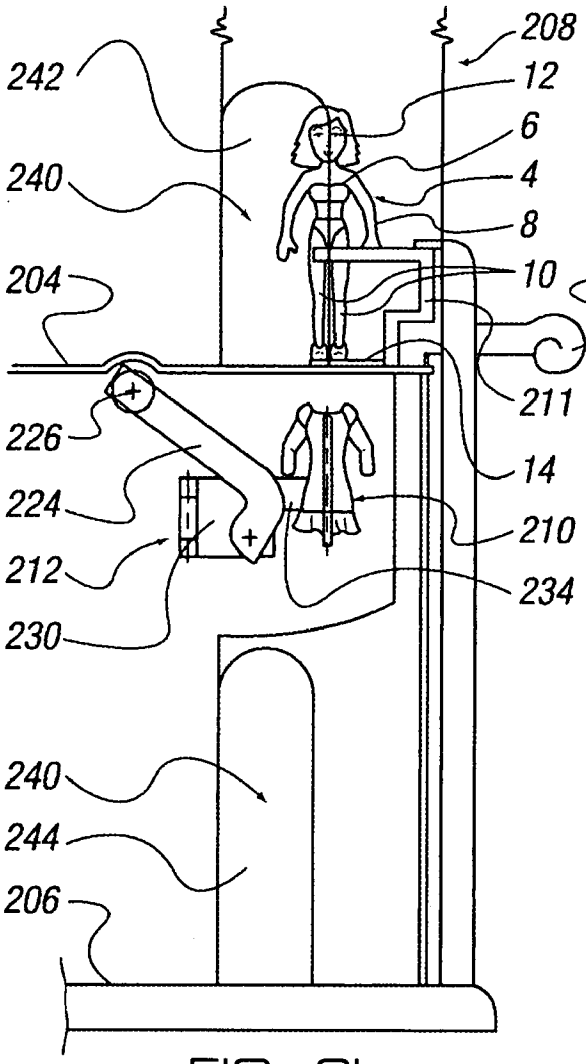

As a doll moves up or down in lift 208, as controlled by a user using user actuation means in the form of handle 209 protruding outwardly of lift arrangement 208, as shown in FIGS. 6*b*-6*d*, the doll passes between clothing 210 provided at free ends 234 of support member 230 and the clothing attached to the doll as hereinbefore described. Openings 242, 244 are provided in lift 208 adjacent upper playbase 204 and lower playbase 206 to allow the doll to enter and exit the lift and move on the respective playbase surfaces.

Thus, there the doll can be undressed or dressed in two positions; via the wardrobe 238 when the movement means are in the first raised position and via the lift 208 when the movement means are in the second lowered position. The strength of the magnets can be adjusted in the two positions to adjust whether the doll is dressed or undressed in said two positions. In either position, the user does not have to directly dress the doll, thereby giving the impression that the doll is dressing itself when entering the wardrobe and/or lift.

The doll can move along the playbase surfaces 204, 206 and up and down the lift via any conventional means. In the illustrated example, handle 209 is typically attached to lift platform 211 and the base 14 of doll 4 is movable onto platform 211. Handle 209 and thus platform 211 is slidably mounted in a slot (not shown) in lift housing 208 and/or on a shaft. Frictional engagement between the handle and the shaft maintains the lift in a required position with respect to the lift housing until a user moves handles 209 in a required direction (i.e. in an upwardly or downwardly direction).

It will be appreciated that any other articles or objects can be placed in housing 202 to increase the realism of the toy to a user. Any type of clothing or article can also be used with the movement means for detachable attachment to the doll. Any combination of the abovementioned features can be provided together or alone to form the apparatus of the present invention.

Referring to FIGS. 7*a*-7*f*, there is illustrated a yet further embodiment of the present invention in which a playbase 302 is provided in such a design to represent a hair salon or dressing room. More specifically, playbase 302 includes a dressing table 304 with a mirror 306 located thereon, and a chair 308 on which a doll 310 can be seated. A table 312 is provided on which a plurality of mannequin heads 314 are provided, each head 314 having an article located thereon in the form of a unique style of hair piece 316.

The doll 310 is in the form of a human female having a head portion 318 and body portion 320. In accordance with the present invention, magnets (not shown) form or are provided on or in the head portion 318.

Movement apparatus in the form of a hair dryer hood 322 are provided on playbase 302 to allow one or more of the hairpieces 316 to be moved between the mannequin heads 314 and the head portion 318 of doll 310.

The hair dryer hood 322 includes a support frame in the form of an elongate arm member 324 which is rotatably mounted to table 312. A first support member 326 is pivotally mounted to arm member 324 via pivot joint 328. A support surface is provided on the interior surface 330 of a substantially dome shaped hood or casing 332 and hood 332 can be fixedly or pivotally mounted to support member 326. In accordance with the present invention, magnets form or are provided on or in at least the interior surface of said hood 332.

Figure 7A:
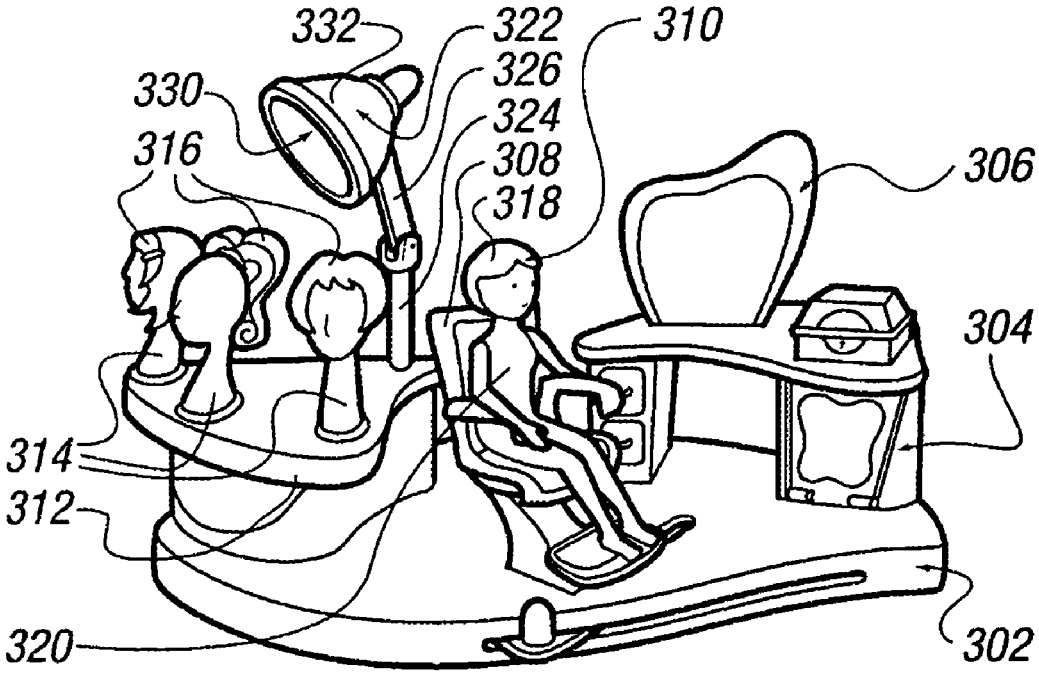
FIGS. 7*a*-7*f* illustrate the steps involved in movement of articles into engagement with a toy in a yet further embodiment.
Figure 7B:
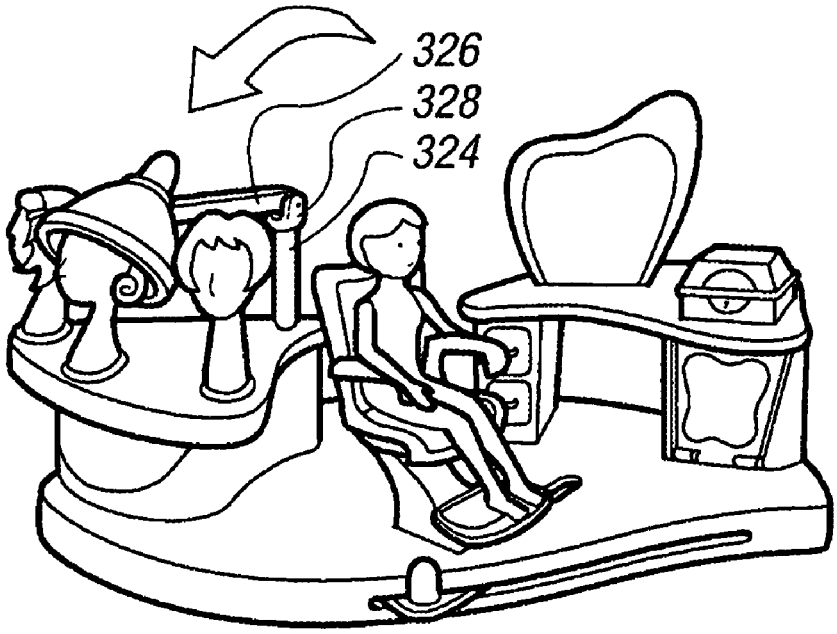
Figure 7C:
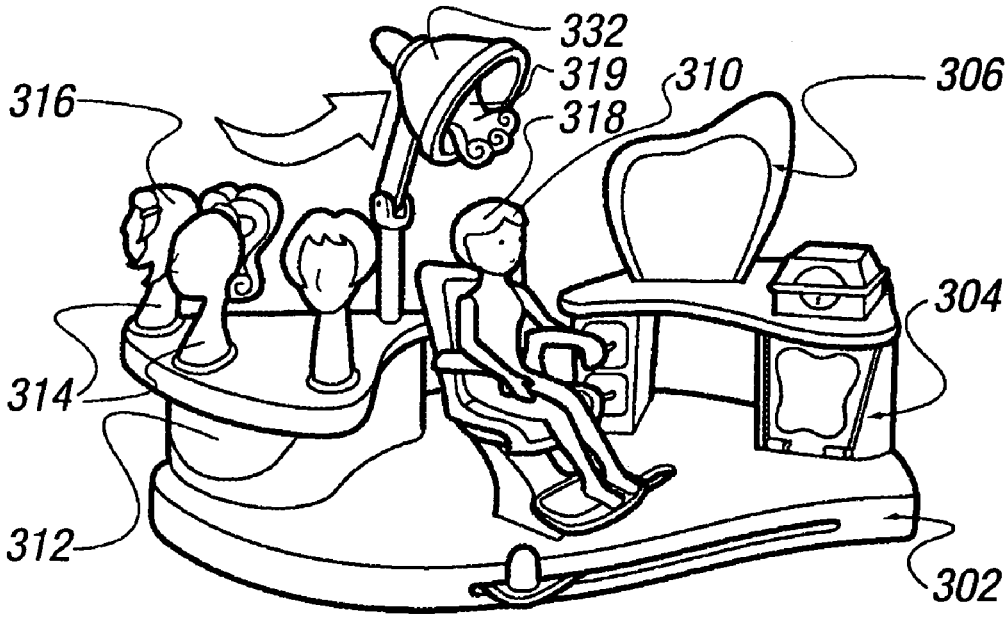

The hood 332 can be moved from a spaced distance apart from the hairpieces 316, as shown in FIG. 7*a*, to a position adjacent a user selected hairpiece, as shown in FIG. 7*b*. Magnets are typically provided in or on the hairpiece and when the interior surface 330 of hood 332 is brought within a predetermined distance of a hairpiece 316, the magnetic attraction between the same causes the hairpiece to engage with the interior surface 330 of hood 332. Hood 332 can then be moved a spaced distance apart from mannequin 314, as shown in FIG. 7*c*, towards doll 310 with the chose hairpiece engaged to the same.

Figure 7D:
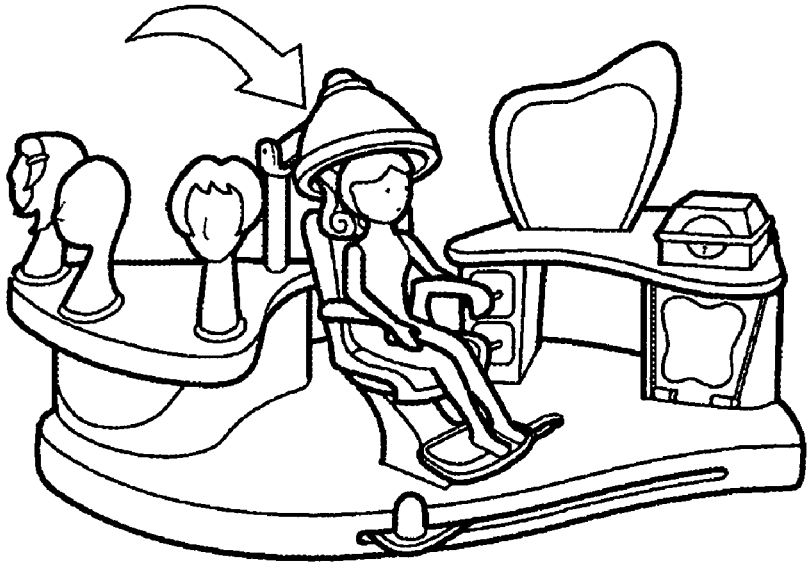

When hood is within a pre-determined distance of head portion 318 of doll 310, as shown in FIG. 7*d*, the magnetic attraction between the magnets provided in head portion 318 and hair piece 316 is greater than the magnetic attraction between the magnets provided in hood 332 and the hair piece 316. As such, chosen hair piece 316 moves into engagement with head portion 318. Hood 332 can then be lifted away from doll 310 leaving the user selected hair piece 316 in place on head portion 318, as shown in FIG. 7*e*.

Figure 7E:
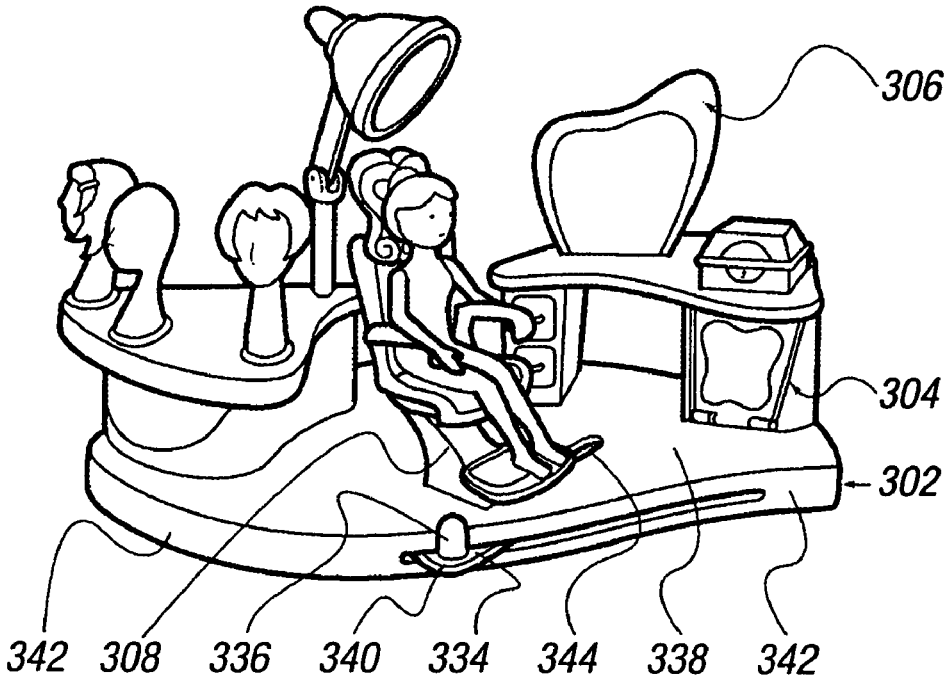
Figure 7F:
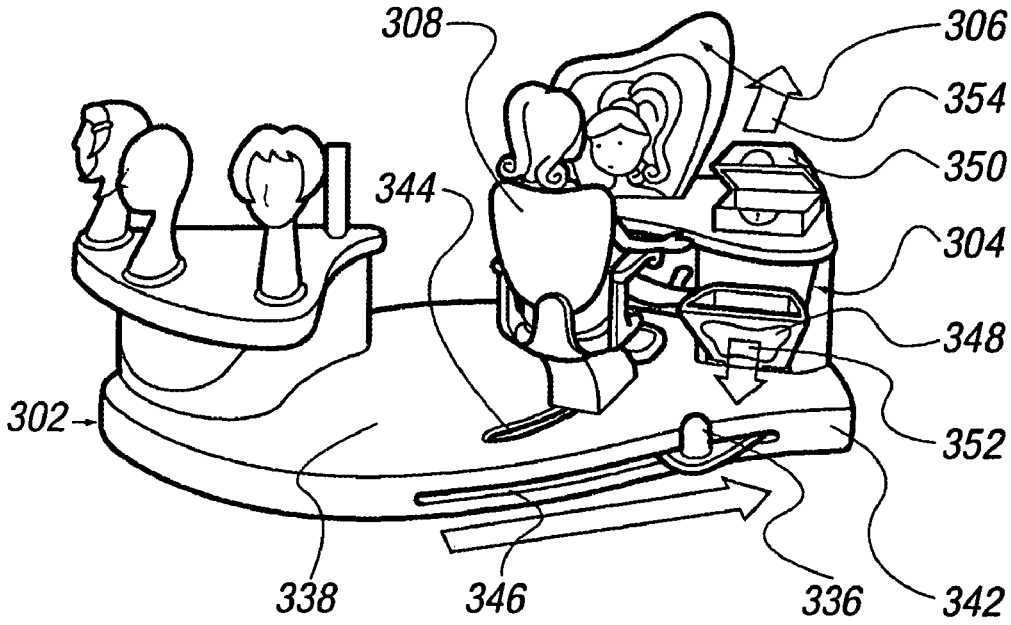

With the hair piece in place on doll 310, the chair 308 can then be moved to a position adjacent the dressing table 304, as shown in FIG. 7*f*. Movement of chair 308 can take place via any conventional mechanism but in the illustrated example, the base of chair 308 is connected to an arm linkage 334 underneath the upper surface 338 of playbase 302. User actuation means in the form of a handle 336 is provided on a free end 340 of arm linkage 334, the free end 340 typically protruding from the side 342 of the playbase to allow a user to easily operate the handle 336.

A slot 344 is provided on upper surface 338 to allow chair 308 to be slidably moved between the position shown in FIG. 7*e*, wherein the chair is a spaced distance apart from dressing table 304, to the position shown in FIG. 7*f*, wherein the chair is adjacent the dressing table 304. A slot 346 is provided in side wall 342 of playbase 302 to allow arm linkage 334 to be slidably moved by a user between the left side position, shown in FIG. 7*e*, to the right side position, shown in FIG. 7*f*.

Movement of chair 308 towards dressing table 304 can actuate movement of one or more further articles provided on the playbase, such as the opening of a cupboard 348 in dressing table 304 or opening of a jewellery box 350 on table 304, as shown by arrows 352 and 354 respectively in FIG. 7*f*. Movement of chair 308 away from table 304 can move the articles in reverse. Any suitable mechanical or electrical movement mechanism can be used for actuating movement of the further articles.

The movement apparatus in the form of hood 322 can be moved manually by a user or actuation means can be provided to allow movement as required. In order to remove the hair piece from doll 310, a user can manually remove the same, a means of increasing or decreasing the magnetic force of any of the magnets provided on the hair piece 316, hood 332 or head portion 318 can be used to allow the magnetic attraction between the head portion 318 and the hair piece 316 to be less than the hair piece and hood 332, thereby allowing removal of the hair piece for the doll 310 in a reverse process to that described above.

Thus, it can be seen in this embodiment that a realistic hair salon is provided which gives the impression of the doll having a new hair style when the hood 332 is removed from the head portion of the doll.

The invention claimed is:

1. A toy, said toy including at least one toy member and one or more articles for detachable attachment to said toy member, characterized in that said toy further includes movement apparatus movably mounted to said toy and having supports pivotably mounted thereto for moving said one or more articles between a first position, wherein the one or more articles are attached to the supports and detached from and a spaced distance apart from said, toy member, and a second position, wherein the movement apparatus moves the one or more articles from the first position to the second position so that when in the second position the supports pivotablv move the one or more articles toward the toy member and the one or more articles become detached from the movement apparatus and automatically attached to the toy member.

2. A toy according to claim 1 characterised in that the at least one toy member and/or the movement apparatus are provided on a playbase in use.

3. A toy according to claim 2 characterised in that the at least one toy member and/or the movement apparatus are movable or movably mounted with respect to said playbase.

4. A toy according to claim 1 characterised in that the one or more articles are detachably attached to the toy member via engagement means including any or any combination of one or more clips, hooks, ties, interconnecting members or magnetic means.

5. A toy according to claim 4 characterised in that magnetic means are associated with the one or more articles, the toy member and the movement apparatus; the magnetic attraction between the one or more articles and the toy member being greater than the magnetic attraction between the one or more articles and the movement apparatus, thereby allowing transfer of the one or more articles from the movement apparatus to the toy member.

6. A toy according to claim 5 characterised in that the one or more articles are moved from the movement apparatus to said toy member when the movement apparatus and/or the toy member are moved within a pre-determined distance of each other.

7. A toy according to claim 1 characterised in that the one or more articles are detachably secured to the movement apparatus via securing means including any or any combination of one or more clips, hooks, ties, interconnecting members or magnetic means.

8. A toy according to claim 1 characterised in that the movement apparatus includes a support frame, said support frame having one or more support members to which the one or more articles can be detachably secured to in use.

9. A toy according to claim 8 characterised in that the support frame is movably mounted on a playbase in use.

10. A toy according to claim 8 characterised in that the one or more support members are movably mounted on said support frame in use.

11. A toy according to claim 8 characterised in that one or more support members are provided with a support surface to which the one or more articles are detachably attached to and said support surface is movable relative to a part of said support members.

12. A toy according to claim 11 characterised in that the support surface is pivotally movable with respect to the one or more support members.

13. A toy according to claim 12 characterised in that the support surface is movable, at least in part, as a result of the magnetic attraction between the one or more articles and the toy member.

14. A toy according to claim 1 characterised in that the movement apparatus includes user actuation means to allow a user to actuate movement of the same.

15. A toy to claim 1 characterised in that the movement apparatus is formed with or provided in a housing in use.

16. A toy according to claim 15 characterised in that the housing has one or more openings defined therein and said toy member is movable in and/or out of said openings in use.

17. A toy according to claim 16 characterised in that the housing is in the form of a lift which is movable between first and second spaced apart surfaces of a playbase in use.

18. A toy according to claim 1 characterised in that the movement apparatus is in the form of a hair drying hood and the one or more articles detachably attached thereto include one or more hairpieces.

19. A toy according to claim 1 characterised in that the one or more articles include any or any combination of one or more garments, accessories, appendages or hairpieces or parts thereof.

20. A toy according to claim 1 characterised in that each of the at least one toy member, the movement apparatus and the one or more articles include one or more magnets and the polarity of the magnets of the one or more articles is opposite to that of the magnets on the movement apparatus and the at least one toy member to allow attraction between the same.

21. A toy according to claim 1 characterised in that the toy member includes any of any combination of a character, human, animal, monster or imaginary creature.

22. A toy according to claim 2 characterised in that the movement apparatus is movable into and/or out of one or more openings defined in a housing located on said playbase.

23. A method of using a toy, said toy including at least one toy member and one or more articles for detachabale attachment to said at least one toy member, further including a first movement apparatus movably mounted to said toy and a support pivotably mounted thereto for detachably holding said one or more articles, said toy further includes second movement apparatus holding said toy member, said method including the steps of:

slidably moving said second movement apparatus toward said first movement apparatus to position said toy member adjacent thereto; and, slidably moving said first movement apparatus between a first position, wherein the one or more articles are attached to the first movement apparatus and detached from and a spaced distance apart from said at least one toy member, and a second position, wherein the first movement apparatus moves the one or more articles from the first position to the second position so that when in the second position the one or more articles become detached from the first movement apparatus by the support pivoting and are automatically attached with said at least one toy member.

* * * * *